US007207908B1

(12) United States Patent
Gizowski

(10) Patent No.: US 7,207,908 B1
(45) Date of Patent: Apr. 24, 2007

(54) INSERT FOR ALLOWING THE FREE ROTATION OF A CUTTING TIP ON AN ARROW SHAFT

(76) Inventor: Frederick Scott Gizowski, 2664 Sam Houser Rd., Vale, NC (US) 28168

( * ) Notice: Subject to any disclaimer, the term of this patent is extended or adjusted under 35 U.S.C. 154(b) by 0 days.

(21) Appl. No.: 11/354,366

(22) Filed: Feb. 16, 2006

(51) Int. Cl.
*F42B 6/08* (2006.01)

(52) U.S. Cl. ..... 473/583

(58) Field of Classification Search ..... 473/578, 473/583, 584
See application file for complete search history.

(56) References Cited

U.S. PATENT DOCUMENTS

| | | | | |
|---|---|---|---|---|
| 3,388,696 | A | 6/1968 | Hoverath et al. | |
| 3,910,579 | A * | 10/1975 | Sprandel | 473/584 |
| 4,534,568 | A * | 8/1985 | Tone | 473/583 |
| 4,671,517 | A * | 6/1987 | Winters | 473/583 |
| 4,781,386 | A * | 11/1988 | Armitage | 473/584 |
| 4,943,067 | A | 7/1990 | Saunders | |
| 5,257,809 | A * | 11/1993 | Carrizosa | 473/584 |
| 5,496,042 | A * | 3/1996 | Craft et al. | 473/583 |
| 5,609,147 | A | 3/1997 | Withorn, Jr. | |
| 5,971,875 | A | 10/1999 | Hill | |
| 6,478,700 | B2 | 11/2002 | Hartman | |
| 6,595,880 | B2 | 7/2003 | Becker | |
| 6,887,172 | B2 * | 5/2005 | Arasmith | 473/583 |
| 7,037,222 | B2 * | 5/2006 | Mizek et al. | 473/583 |

* cited by examiner

*Primary Examiner*—John A. Ricci
(74) *Attorney, Agent, or Firm*—Theresa M. Seal

(57) ABSTRACT

A spinning insert for allowing the free rotation of a cutting tip (broadhead) relative to the rotation of an arrow is mounted to the tip end of the arrow and includes an insert having a flange that projects from the tip end of the arrow, a stepped and partially threaded cavity extending within the insert, a shaft axially projecting from the insert and concealed within the arrow, and a sleeve that is mounted to the shaft and abuts the interior annular surface of the arrow. The cutting tip is screwed into the cavity of the insert and the spinning insert is mounted to the tip end of the arrow so that the cutting tip can freely spin or rotate thereon and separate from the rotation of the arrow during the flight of the arrow and also when contact with a target (a game animal) is made thereby allowing the cutting tip to continue its rotation and rotate off matter, such as bone, providing for deeper penetration of the cutting tip within the body of the game animal from less draw weight resulting in a quicker and more humane kill.

12 Claims, 5 Drawing Sheets

INSERT FOR ALLOWING THE FREE ROTATION OF A CUTTING TIP ON AN ARROW SHAFT

FIELD OF THE INVENTION

The present invention pertains to mounts and inserts for attaching the cutting tip or cutting blades to the shaft of an arrow, and more particularly pertains to a spinning insert securable to the tip end of an arrow for allowing the cutting tip to freely rotate relative to the arrow both when the arrow is in flight and when contact is made with the target.

BACKGROUND OF THE INVENTION

Archery hunting is a popular sport that requires a number of skills and talents that are honed and developed through years of target practice and actual hunting. Certainly one of the most critical skills is developing the ability to bring the bow to full draw for obtaining maximum velocity for the arrow upon release and optimum shot placement on the target—the game animal. This requires both physical strength and finding a bow that has a comfortable draw weight (poundage of pull to get the bow to full draw) for that individual. However, it often occurs that the individual doesn't develop the requisite strength and thus when hunting exerts too little (pull) draw weight on the bow so that when the target is struck the arrow doesn't achieve sufficient penetration to the vitals of the game animal. In addition, the energy and lethality of the arrow is immediately diminished upon striking bone. Thus, the arrow must cut or break bone to reach the animal's vitals, and this results in the game animal being wounded but not quickly killed. The game animal often evades tracking and location by the hunter and dies in the undergrowth without ever being found. Therefore, it is desirable to design a cutting tip that does not completely lose energy upon striking the target, and is not compelled to follow the predetermined path of the arrow upon the arrow striking the target and then entering the target. The following patents disclose various improvements in the design of the cutting tip and the arrow to improve spin, stability, and accuracy.

For example, the Hoverath et al. patent (U.S. Pat. No. 3,388,696) discloses a magazine and blowpipe for projecting elongate projectiles and which includes a tubular pipe, a magazine, and a plurality of projectiles stored in the magazine and ejected one at a time from a discharge end of the pipe.

The Sprandel patent (U.S. Pat. No. 3,910,579) discloses a swivel action adaptor for securing an arrowhead to the front end of an arrow shaft that includes a bushing that is cemented to the forward end of the arrow shaft and a spindle mounted to the bushing and having a tapered end that is cemented in the socket of the arrowhead.

The Simo patent (U.S. Pat. No. 4,175,749) discloses an arrowhead body for attachment between the nosepiece and the head end of the arrow shaft, and which includes an adaptor having a having a rearward adapter shaft for insertion into the arrow shaft and an opposite forwardly extending adaptor shaft for attachment to the arrowhead body with the adaptor shafts and the adaptor in axial alignment with the arrow shaft and the arrowhead body.

The Tone patent (U.S. Pat. No. 4,534,568) discloses a low frictional rotational element for interconnecting a broad blade arrowhead to the leading end of an arrow shaft, and which includes a housing for permanent installation to the leading end of the arrow shaft and an insert for disposition within the housing, with the insert including annular ridges that serve as low friction bearing surfaces against the inner annular surface of the housing. The insert includes a threaded hole to receive the threaded stud of the arrowhead.

The Saunders patent (U.S. Pat. No. 4,943,067) discloses an arrow insert for a hollow arrow shaft that includes annular alignment rings, an enlarged shoulder, and a glue trap for gluing the insert to the inside annular surface of the arrow so that a fieldpoint can be secured to the insert and in position at the front end opening of the shaft of the arrow.

The Withorn, Jr. patent (U.S. Pat. No. 5,609,147) discloses an arrow thread tracking apparatus for a bow that includes a bolt assembly secured to the bow and a thread attached to the bolt assembly and the arrow for tracking the arrow.

The Hill patent (U.S. Pat. No. 5,971,875) discloses a vaneless arrow shaft that includes a spinner tube having spiral grooves that is placed within the arrow shaft adjacent the nock end, and the arrow shaft having dimples that engage the grooves so that rotation is imparted to the arrow shaft when the bowstring is released for launching the arrow shaft.

The Hartman patent (U.S. Pat. No. 6,478,700 B2) discloses an arrow spin device that includes a screw shaft having cylindrical leading and tailing ends and which is inserted into the arrow shaft so that engagement by, and release from, the bowstring imparts a spin to the arrow without the need for fletching.

The Becker patent (U.S. Pat. No. 6,595,880 B2) discloses a fluted arrow that can be lighter and stronger than standard arrows, and a fluted arrow that has grooves or spirals along its length to impart rotation to the arrow for increased stability and greater velocity.

Nonetheless, despite the ingenuity of the above devices, there remains a need for an spinning insert to which the cutting tip can be attached for allowing the cutting tip to freely rotate relative to the arrow shaft whereupon when contact with the target occurs, the cutting tip can rotate off solid objects such as bone within the target to achieve greater penetration and a quicker, more humane kill.

SUMMARY OF THE INVENTION

The present invention comprehends a spinning insert that is mounted to the tip end of the shaft of an arrow and, more specifically, within the shaft of the arrow at the tip end so that the spinning insert, and a cutting tip, such as a broadhead, that is secured to the spinning insert, can both freely spin or rotate while in flight and when contact with the target is made to achieve greater penetration and thus quicker and more humane kills. The spinning insert and the cutting tip thus rotate independent of the spin or rotation of the arrow, and as a result, greater penetration, and thus quicker and more humane kills, is obtained because the cutting tip doesn't have to follow the predetermined path of the arrow but can rotate off solid matter and objects such as bone for deeper penetration into the game animal's vitals. Thus, the spinning insert allows the cutting tip to take the easiest path through the animal by allowing the cutting tip to freely spin about the tip end of the shaft of the arrow and independently of the rotation of the arrow.

The spinning insert includes an insert that is of a generally elongated and cylindrical shape. The insert includes a flange or lip, and the flange includes a pair of oppositely disposed flats having a hex nut shape to accommodate pliers or an appropriately dimensioned socket to facilitate the securement and removal of the cutting tip to and from the spinning insert. Extending from the insert is a shaft, and the shaft and insert are in axial alignment. Formed within the insert, and extending to the shaft, is a stepped cavity or chamber. The stepped cavity or chamber is further divided into an upper non-threaded portion and an inner threaded portion, with the upper portion having a greater diameter than the inner threaded portion. The inner threaded portion terminates with a blind hole adjacent the shaft. The shaft includes a distal end, and the distal end includes an annular groove for receiving a c-clip. A cylindrical sleeve includes a sleeve bore that is sized to be slipped onto the shaft whereupon the length of the sleeve is less than that of the shaft so that after the sleeve has been slipped onto the shaft, the c-clip can be fitted into the annular groove thereby holding the sleeve onto the shaft. The shaft and the insert are capable of spinning or rotating together relative to the sleeve and the arrow.

With the sleeve placed upon the shaft and the c-clip slipped into the annular groove the spinning insert is now assembled and can be placed into the hollow of the shaft of the arrow adjacent the tip end. The insert and the shaft will be concealed and enclosed within the shaft and the flange will remain protruding from the shaft of the arrow so that the cutting tip, such as a broadhead, can be screwed into the inner threaded portion for securing the broadhead to the spinning insert. In addition, the cutting tip can be screwed into the inner threaded portion prior to seating the spinning insert within the shaft of the arrow at the tip end thereof. The sleeve is wedged within the hollow of the shaft of the arrow adjacent the tip end and is stationarily secured therein thus allowing the shaft, the insert and the broadhead to spin or rotate in unison and relative to the arrow when the arrow is in flight and upon contact with the target such as the game animal. In effect, the spinning insert allows the arrow to continue its rotation separate from the rotation of the cutting tip (the broadhead), so that the cutting tip doesn't have to follow the arrow's predetermined flight path when contact is made with the target—the game animal. The cutting tip can thus spin and deflect off matter, such as bone, thereby taking the easiest path into and through the animal to achieve deeper penetration and a quicker and more humane kill.

It is an objective of the present invention to provide a spinning insert for the cutting tip of an arrow that allows the cutting tip to spin off of solid objects such as bone so that the cutting tip can take the easiest path through the animal.

It is another objective of the present invention to provide a spinning insert for mounting the cutting tip to an arrow and which allows the cutting tip to freely spin with respect to the arrow so that an archer can use less draw weight to achieve the same or better penetration of the cutting tip in the animal.

It is yet another objective of the present invention to provide a spinning insert for mounting the cutting tip to the arrow so that the cutting tip can freely spin relative to the arrow and thus allows a hunter of limited draw weight the ability to hunt larger game animals.

It is still yet another objective of the present invention to provide a spinning insert for mounting the cutting tip to the arrow that allows the cutting tip to freely spin relative to the arrow and that results in quicker and more humane kills with less shock to the game animal.

It is still yet a further objective of the present invention to provide a spinning insert for mounting the cutting tip to the arrow and that allows the cutting tip to freely spin relative to the arrow so that when contact is made with the target, the cutting tip can spin off of solid matter such as bone, and doesn't have to cut or break bone, thus resulting in a quicker and more humane kill with less shock to the game animal.

Still a further objective of the present invention is to provide a spinning insert for mounting the cutting tip to the arrow that allows the cutting tip to freely spin relative to the arrow so that the cutting tip can spin off of bone and achieve a lethal penetration to the game animal's vitals thereby resulting in a quicker and more humane kill.

Still another objective of the present invention is to provide a spinning insert for mounting the cutting tip to the arrow that allows the cutting tip to freely spin relative to the arrow so that when the target is struck the cutting tip is able to deflect off bone instead of losing energy by having to cut through bone.

Still yet a further objective of the present invention is to provide a spinning insert for mounting the cutting tip to the arrow that allows the cutting tip to freely spin relative to the arrow so that the cutting tip can spin off bone and work more efficiently by taking the easiest route through the game animal.

Still yet another objective of the present invention is to provide a spinning insert for mounting the cutting tip to the arrow in which the spinning insert can be used with any arrow that will receive a screw-in cutting tip.

Yet another objective of the present invention is to provide a spinning insert for mounting the cutting tip to the arrow that allows the cutting tip to freely spin relative to the arrow thereby producing better arrow flight and reduced planning.

Yet still another objective of the present invention is to provide a spinning insert for mounting the cutting tip to the arrow wherein the spinning insert can be manufactured from an aluminum alloy, titanium, steel or carbon composite.

Yet still a further objective of the present invention is to provide a spinning insert for mounting the cutting tip to the arrow that allows the individual to shoot a more comfortable draw weight and achieve better shot placement.

A further objective of the present invention is to provide a spinning insert for mounting the cutting tip to the arrow wherein any cutting tip currently available can be accommodated by and mounted to the spinning insert.

A yet further objective of the present invention is to provide a spinning insert for mounting the cutting tip to the arrow that allows the threaded shaft of the cutting tip to be disposed within the tip end of the arrow by mounting to the spinning insert and thus adds strength to the arrow shaft but doesn't increase the overall length of the arrow shaft.

These and other objects, features and advantages will become apparent to those skilled in the art upon a perusal of the following detailed description read in conjunction with the accompanying drawing figures and appended claims.

DETAILED DESCRIPTION OF THE PREFERRED EMBODIMENT

Illustrated in FIGS. 1–5 is a spinning insert 10 that is removably attachable to the shaft of an arrow, and which allows a cutting tip securable to the shaft to freely spin or rotate relative to the rotation of the shaft when the arrow is in flight, and, more importantly, upon entry of the arrow into a game animal. The cutting tip doesn't have to follow the predetermined path of the shaft of the arrow upon striking and entering the body of the game animal by attachment to the spinning insert 10 of the present invention. The spinning insert 10 provides the cutting tip with the ability to freely spin or rotate relative to the rotation of the shaft of the arrow and allows the cutting tip to deflect and spin off of solid objects, such as bone, thereby achieving deeper penetration to the vital organs within the body of the game animal and a quicker and more humane kill. The use of the spinning insert 10 of the present invention allows for better shot placement because the hunter is able to stay within his or her comfort zone regarding draw weight (the hunter doesn't not have to overextend his or her draw weight). In addition, the use of the spinning insert 10 overcomes the problem of too little draw weight by letting the arrow work more efficiently in taking the easiest path through the animal.

Figure 3:
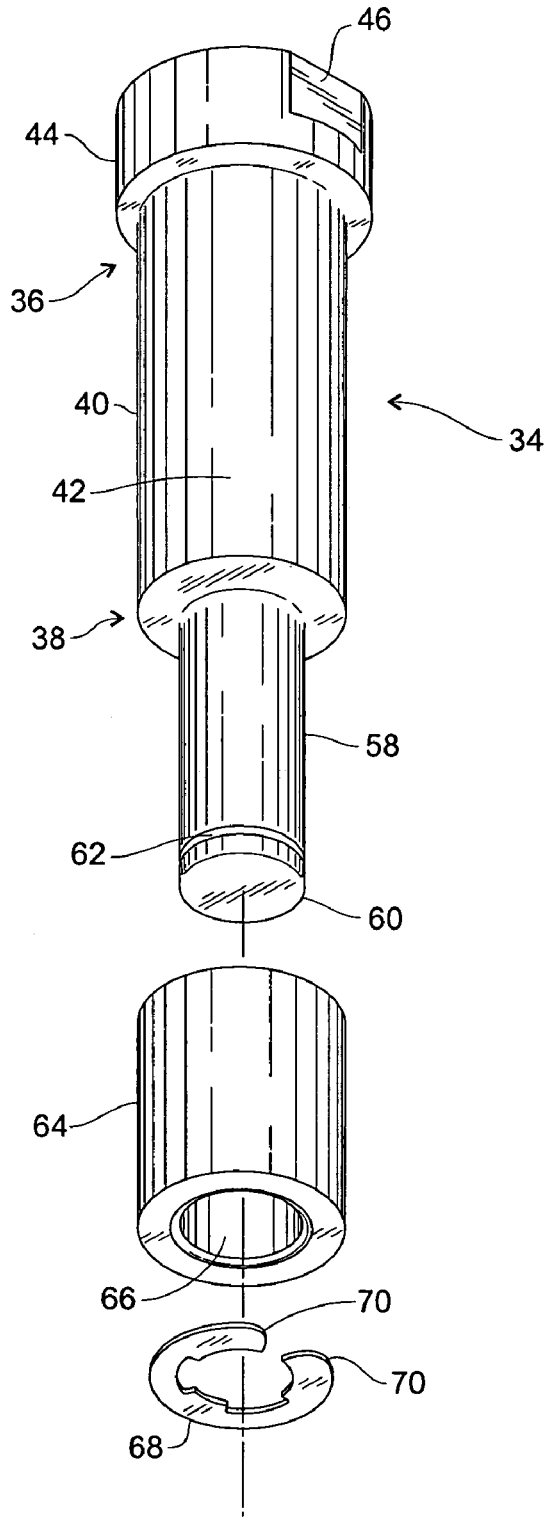
FIG. 3 is an exploded view of the spinning insert of the present invention illustrating the alignment and configuration of the structural elements of the spinning insert prior to the assemblage.
Figure 4:
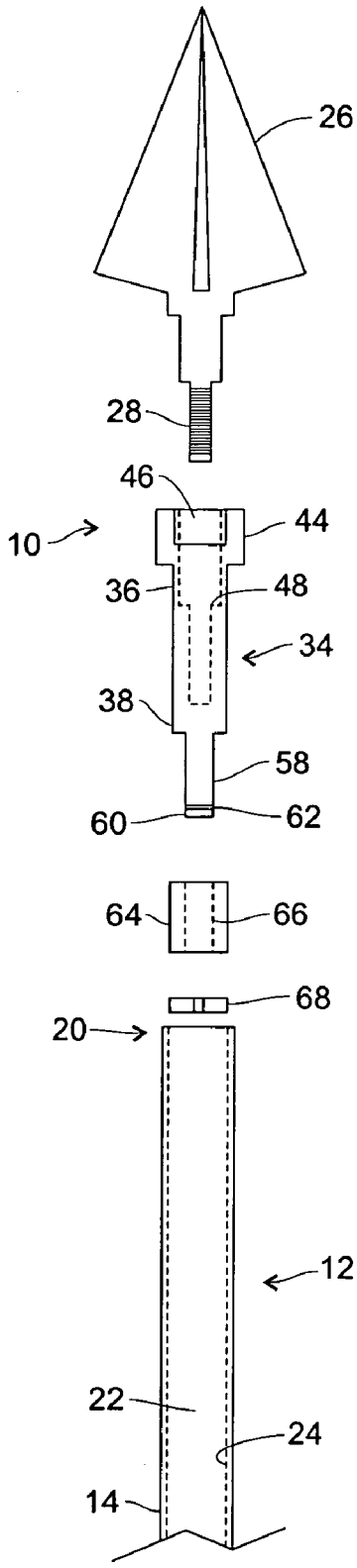
FIG. 4 is an elevational view of the spinning insert of the present invention illustrating the alignment of the broadhead (the cutting tip) of the arrow with the spinning insert prior to the securement of the broadhead to the spinning insert.
Figure 5:
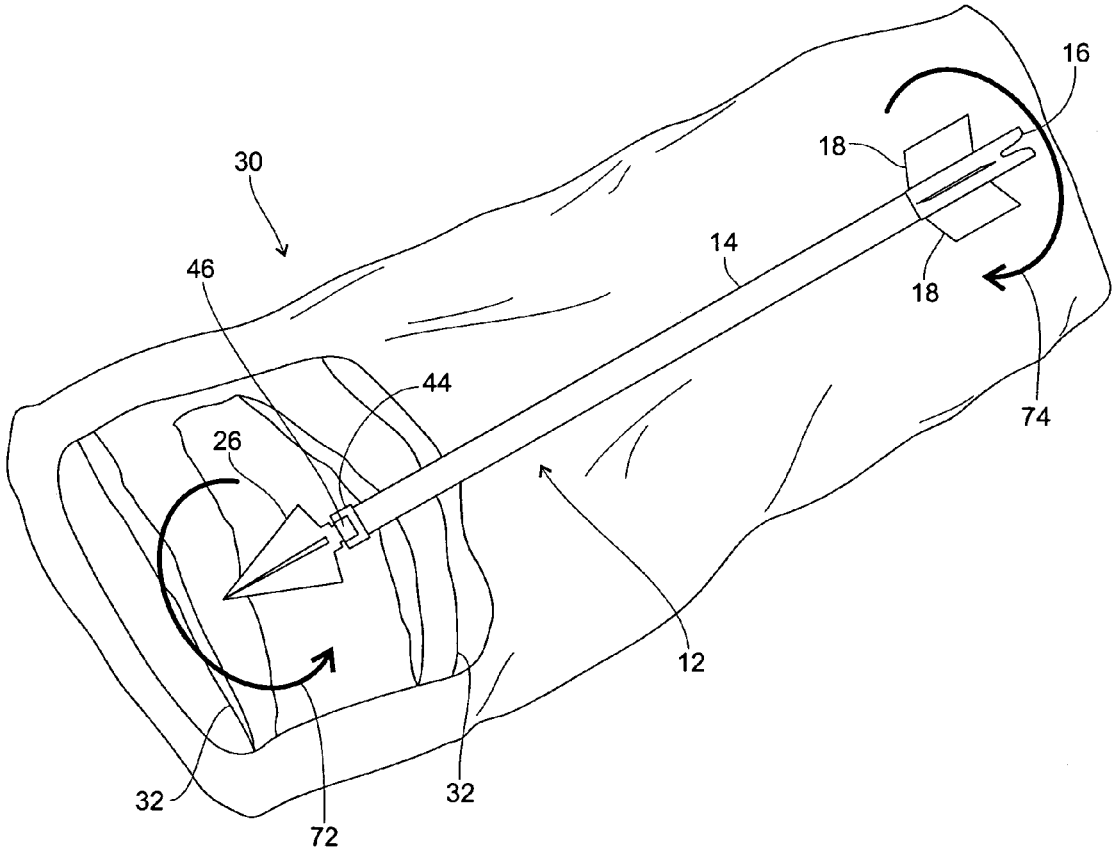
FIG. 5 is a perspective view of the spinning insert of the present invention illustrating the cutting tip entering the body of the game animal and then spinning off of bone upon entry into the body of the game animal while the rotation of the arrow shaft continues separate from that of the cutting tip.

Illustrated in FIGS. 4 and 5 is a representative arrow 12. The arrow 12 includes a shaft 14, a nock 16, a plurality of vanes 18 and a point or tip end 20. The shaft 14 of the arrow 12 includes a hollow passageway 22 coequal in length with the shaft 14, and the hollow passageway 22 defines an interior annular shaft surface 24. The spinning insert 10 is mounted to the point end 20 of the shaft 14, with a major portion of the spinning insert 10 being disposed within the hollow passageway 22 and abutting the interior annular shaft surface 24. A small portion of the spinning insert 10 projects externally from the tip end 20 of the shaft 14. The spinning insert 10 is adapted to receive a range of cutting tips currently available such as the smaller diameter carbon arrows that comprise the bulk of the market. FIGS. 3–5 illustrate a representative cutting tip 26, which can comprise a cutting blade, and which is more commonly referred to as a broadhead. The cutting tip 26 includes a threaded shaft 28 for screwing the cutting tip 26 into the spinning insert 10 as will be hereinafter further described. Also shown in FIG. 5 is a representative game animal 30, and, more specifically, a side of the game animal 30 pierced and opened (exaggerated for illustrative purposes) from contact and penetration by the cutting tip 26 thereby revealing several rib bones 32 of the rib cage. The separate rotation of the cutting tip 26 relative to the shaft 14 of the arrow 12 are denoted and will be hereinafter further described.

As shown in FIGS. 1–5, the spinning insert 10 includes an elongated insert 34. The insert 34 includes a first end 36, an opposite second or bottom end 38, a main body portion 40 and a cylindrical surface 42. Located at the first end 36 is a flange or lip 44 that externally projects from the tip end 20 of the shaft 14 when the spinning insert 10 is mounted thereto. The flange 44 includes a pair of flats 46 with the flats 44 being located 180 degrees from each other. The flats 44 simulate a hex nut shape to facilitate the attachment and removal of the cutting tip 26 on and off the spinning insert 10.

Figure 1:
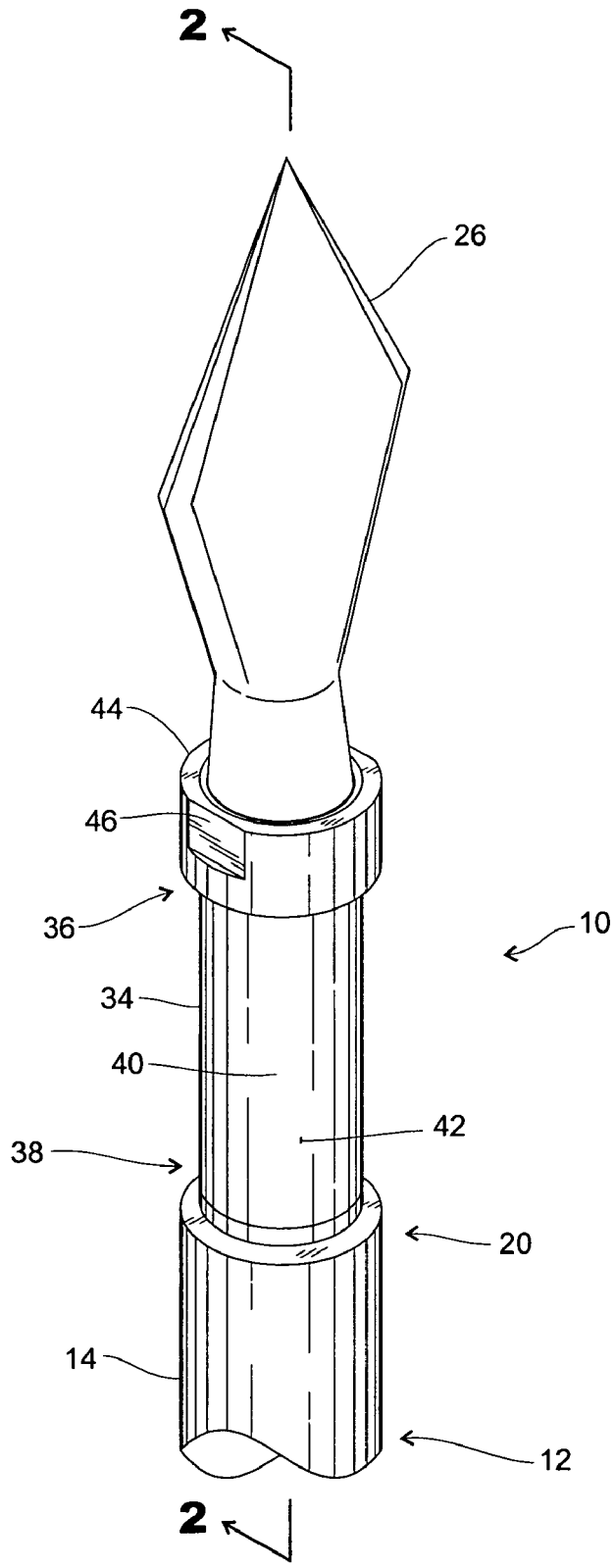
FIG. 1 is a perspective view of the spinning insert of the present invention illustrating the partial insertion of the spinning insert into the tip end of the arrow shaft with a cutting tip secured to the insert for free rotation thereon.
Figure 2:
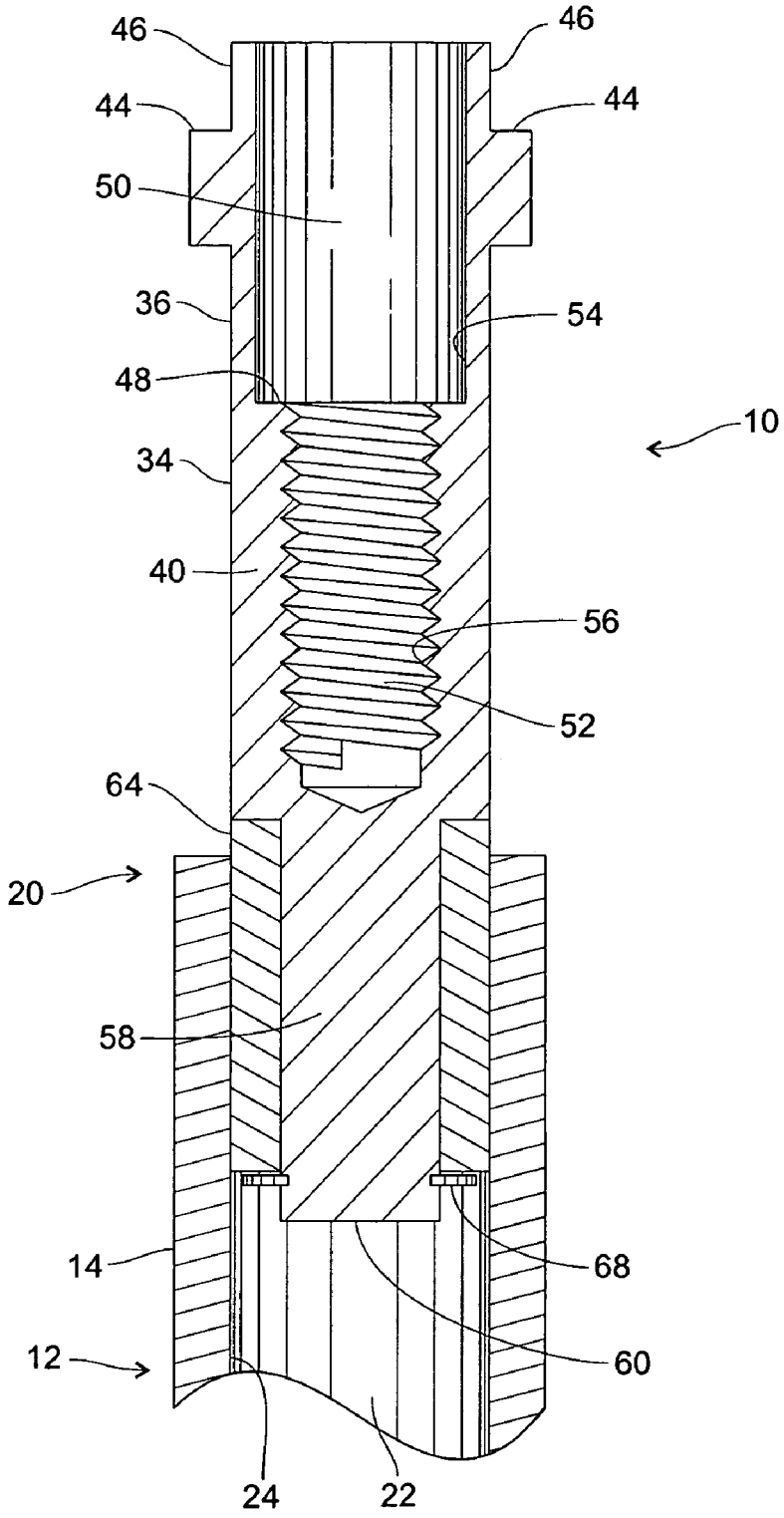
FIG. 2 is a sectioned elevational view of the spinning insert of the present invention taken along lines 2—2 of FIG. 1 illustrating the interconnection of the structural elements that comprise the spinning insert and the insertion of the spinning insert into the tip end of the arrow shaft.

As shown in FIGS. 2 and 4, a stepped cavity or chamber 48 extends within the main body portion 40 of the insert 34, and the stepped chamber 48 is further divided into an upper non-threaded portion 50 and a lower threaded portion 52. The upper non-threaded portion 50 includes a non-threaded annular bore 54 and the lower threaded portion 52 includes an internal annular threaded bore 56 that internally terminates within the main body portion 40. The threaded shaft 28 of the cutting tip 26 is inserted into the stepped chamber 48 and screwed into the threaded lower portion 52 and against the annular threaded bore 56. A shaft 58 is integrally formed from the insert 34 at the second end 38 and extends in axial alignment with the insert 34 from the second end 38 thereof. The shaft 58 has a smaller diameter than the insert 34 and includes a distal end 60, and an annular groove 62 is formed at the distal end. 60

Illustrated in FIGS. 1–4 is a cylindrical sleeve 64 for placement or mounting on the shaft 58. The cylindrical sleeve 64 includes a sleeve bore 66, and the sleeve 64 is slightly shorter in length than the shaft 58. With the shaft 58 projecting from the bottom or second end 38 of the insert 34, the sleeve 64 can be moved or positioned downward relative to the insert 34, and this allows the insert 34 to be machined to smaller diameters. The smaller diameter for the insert 34 allows the insert 34 to be used with smaller diameter carbon arrows that predominate the market. A retaining means is used to hold and maintain the sleeve 66 on the shaft 58. The retaining means preferably includes a c-clip 68 that includes opposed clip ends 70 that can slightly flex away from each other for allowing the c-clip 68 to be slipped about the shaft 58 and then seated within the annular groove 62. In assembling the spinning insert 10 the sleeve 64 is placed on the shaft 58, and then the c-clip 68 is placed on the shaft 58 for maintaining the sleeve 64 in position on the shaft 58. When the spinning insert 10 is fully assembled, the insert 34, the shaft 58, and the sleeve 64 are in axial alignment with each other and with the shaft 14 of the arrow 12. As shown in FIG. 3, when the sleeve 64 is placed upon the shaft 14, and the spinning insert 10 is placed within the passageway 22 of the shaft 14, at the point end 20, the sleeve 64 abuts the interior annular shaft surface 24 and is thus prevented from rotating within the shaft 14 and remains stationarily enclosed therein.

FIG. 5 illustrates a typical use of the spinning insert 10 in so far as the arrow 12 is shown as having pierced the side of the game animal 30 and has entered the body of the game animal 30. Use of the spinning insert 10 allows the cutting tip 26 to take the easiest path through the body of the game animal 30 by letting the cutting tip 26 freely float or spin relative to the rotation of the shaft 14 of the arrow 12. Because the cutting tip 26—and the insert 34 to which the cutting tip 26 is mounted—freely rotates upon the shaft 14, the cutting tip 26, in effect, doesn't have to follow the rotation of the shaft 14 of the arrow 12. Upon release from the bow (not shown) the shaft 14 spins or rotates as it travels through the air and is stabilized by such rotation; and a conventional cutting tip rotates concomitant with the rotation of the arrow. When contact with the target—the game animal—is made with the conventional cutting tip, the rotation of the arrow instantly stops thus dissipating the kinetic energy of the arrow but compelling the conventional cutting tip to continue in the predetermined path of the arrow. However, using the spinning insert 10 of the present invention allows the shaft 14 of the arrow 12 to continue its rotation separate from the rotation of the cutting tip 26 when contact with the target is made. This is shown in FIG. 5 wherein the cutting tip 26 is shown rotating in one direction 72 and the shaft 14 of the arrow 12 shown rotating in the opposite direction 74. Thus, when the contact with the game animal 30 is made, and the cutting tip 26 pierces and enters the body of the game animal 30, the cutting tip 26 doesn't have to follow the predetermined path of the shaft 14 of the arrow 12. Instead, the cutting tip 26 is able to deflect or spin off of solid objects, such as the rib bones 32 shown in FIG. 5, to achieve a deeper penetration within the game animal 30; and this deeper penetration can be achieved through the exertion of less draw weight. Such deeper penetration produces less stress on the animal and a quicker and more humane kill.

A preferred embodiment of the invention is disclosed herein, and it should be understood that numerous modifications, alterations, and variations are possible and practicable by those skilled in the art while still coming within the spirit of the invention and scope of the invention as set forth in the appended claims.

I claim:

1. A spinning insert for mounting to a tip of a shaft of an arrow for allowing a cutting tip securable to the spinning insert to freely rotate relative to the rotation of the arrow, comprising:

an insert having a first end, a second end, and a main body portion;

a flange located at the first end and including a pair of opposed flats;

a stepped cavity extending within the main body portion and including a non-threaded upper portion and a threaded lower portion;

a shaft extending from the second end of the insert and disposed in axial alignment with the insert;

the shaft including a distal end and the distal end including an annular groove;

a sleeve for disposition on the shaft with the length of the sleeve being less than that of the shaft;

retaining means for disposition in the annular groove so that the sleeve can be placed on the shaft with the retaining means disposed within the annular groove for holding the sleeve on the shaft; and the cutting tip securable to the insert for rotation with the insert when the spinning insert is mounted to the tip end of the shaft of the arrow thereby allowing the shaft of the arrow to rotate separate from the rotation of the cutting tip when the arrow is in flight and when the arrow strikes and enters a game animal so that the cutting tip can deflect and rotate off of bone for taking the easiest path through the game animal.

2. The spinning insert of claim 1 wherein the cutting tip includes a screw-in broadhead.

3. The spinning insert of claim 2 wherein the insert, the shaft and the sleeve are disposed in axial alignment to each other when the spinning insert is mounted to the tip end of the shaft of the arrow.

4. The spinning insert of claim 3 wherein the flange projects past the tip end of the shaft of the arrow when the spinning insert is mounted to the tip end thereof.

5. The spinning insert of claim 4 wherein the sleeve abuts the shaft of the arrow at the tip end and is non-rotatable thereby allowing for the free rotation of the insert and the cutting tip that is secured to the insert.

6. The spinning insert of claim 5 wherein the retaining means includes a c-clip removably securable to the annular groove of the shaft.

7. A spinning insert for mounting to a tip end of a shaft of an arrow for allowing a cutting tip securable to the spinning insert to freely rotate relative to the rotation of the shaft of the arrow, comprising:

an insert having a first end, a second end, and a main body portion;

a flange located at the first end and including a pair of opposed flats;

a stepped cavity extending within the main body portion and including a non-threaded upper portion and a threaded lower portion;

a shaft extending from the second end of the insert and disposed in axial alignment with the insert;

the shaft including a distal end and the distal end including an annular groove;

a sleeve for disposition on the shaft with the length of the sleeve being less than that of the shaft;

a c-clip for disposition in the annular groove so that the sleeve can be placed upon the shaft and the c-clip can be disposed in the annular groove for holding the sleeve on to the shaft; and the cutting tip securable to the insert for rotation with the insert when the spinning insert is mounted to the tip end of the shaft of the arrow thereby allowing the cutting tip to freely rotate separate from the rotation of the shaft of the arrow when the arrow is in flight and when the arrow strikes and enters the body of a game animal so that the cutting tip is able to rotate off of bone for taking the easiest path into and through the game animal for achieving deeper penetration within the game animal and quicker and more humane kill.

8. The spinning insert of claim 7 wherein the cutting tip includes a broadhead that can be screwed into the threaded lower portion of the stepped cavity of the insert.

9. The spinning insert of claim 8 wherein the insert, the shaft and the sleeve are disposed in axial alignment to each other when the spinning insert is mounted to the tip end of the shaft of the arrow.

10. The spinning insert of claim 9 wherein the flange externally projects past the tip end when the spinning insert is mounted to the tip end thereof.

11. The spinning insert of claim 10 wherein the sleeve is disposed in abutting relationship to the shaft of the arrow at the tip end when the spinning insert is mounted to the tip end thereby allowing for the free rotation of the insert and the cutting tip that is attached to the insert.

12. A spinning insert for mounting to a tip end of a shaft of an arrow for allowing a cutting tip securable to the spinning insert to freely rotate relative to the rotation of the arrow, comprising:

an insert having a first end, a second end, a main body portion, and a stepped cavity extending from the first end to the second end and within the main body portion;

the insert including a flange that is adjacent the first end of the insert;

the stepped cavity including a non-threaded upper portion and a threaded lower portion;

the flange externally extending past the tip end of the shaft of the arrow when the spinning insert is mounted to the tip end;

a shaft extending from the second of the insert and disposed in axial alignment with the insert;

the shaft including a distal end and the distal end including an annular groove;

a sleeve for disposition on the shaft;

a retaining means for disposition on the sleeve so that the sleeve can be placed on the shaft and then maintained on the shaft by placement of the retaining means on the annular groove of the shaft;

the retaining means including a c-clip that is disposed within the annular groove for holding the sleeve on the shaft;

the cutting tip including a broadhead that can be screwed into the threaded lower portion of the stepped cavity of the insert;

the cutting tip, the insert, the shaft and the sleeve being disposed in axial alignment when the cutting tip is secured to the insert and the insert is mounted to the tip end of the shaft of the arrow;

the sleeve being disposed in internal abutting relationship to the shaft of the arrow adjacent the tip end when the spinning insert is mounted to the tip end thereby allowing the insert and the cutting tip attached to the insert to freely rotate together relative to the rotation of the arrow; and the cutting tip securable to the insert for rotation with the insert when the spinning insert is mounted to the tip end of the shaft of the arrow thereby letting the shaft rotate separate from the rotation of the cutting tip when the arrow is in flight and when the arrow strikes and enters the body of a game animal so that the cutting tip is able to deflect and rotate off bone for taking the easiest path through the game animal resulting in a deeper penetration within the game animal and a quicker and more humane kill.

* * * * *